United States Patent [19]

Ringdal

[11] 3,977,030

[45] Aug. 31, 1976

[54] ARRANGEMENT FOR HAULING UP, LAUNCHING AND STORING OF BOATS AND THE LIKE

[76] Inventor: Lars Ringdal, Montebelloveien 15, Oslo 3, Norway

[22] Filed: Jan. 13, 1975

[21] Appl. No.: 540,541

[52] U.S. Cl. ..... 9/41; 114/.5 BD

[51] Int. Cl.[2] ..... B63B 23/00

[58] Field of Search ..... 114/.5 B, .5 D, .5 R, 114/43.5, 45, 44; 61/64, 65, 67; 9/41, 1 T; 214/1 A, 12, 505, 506, 84

[56] References Cited

UNITED STATES PATENTS

| | | | |
|---|---|---|---|
| 2,723,038 | 11/1955 | Peterson et al. | 214/84 |
| 2,754,017 | 7/1956 | Hart et al. | 61/67 |
| 2,798,625 | 7/1957 | Mamo | 214/84 |
| 3,039,629 | 6/1962 | Cole | 214/84 |
| 3,742,534 | 7/1973 | Guest | 9/1 T |

*Primary Examiner*—Duane A. Reger
*Assistant Examiner*—Jesus D. Sotelo
*Attorney, Agent, or Firm*—Pennie & Edmonds

[57] ABSTRACT

Boats or the like are hauled up, stored and launched by an arrangement consisting of a frame on which buoyancy elements are mounted. The frame has a vertically movable attachment to a floating or fixed stage, quay, or projection on land. The buoyancy elements are rotatably mounted so that they can freely rotate when the boat is hauled up or launched.

12 Claims, 7 Drawing Figures

Fig. 3a.
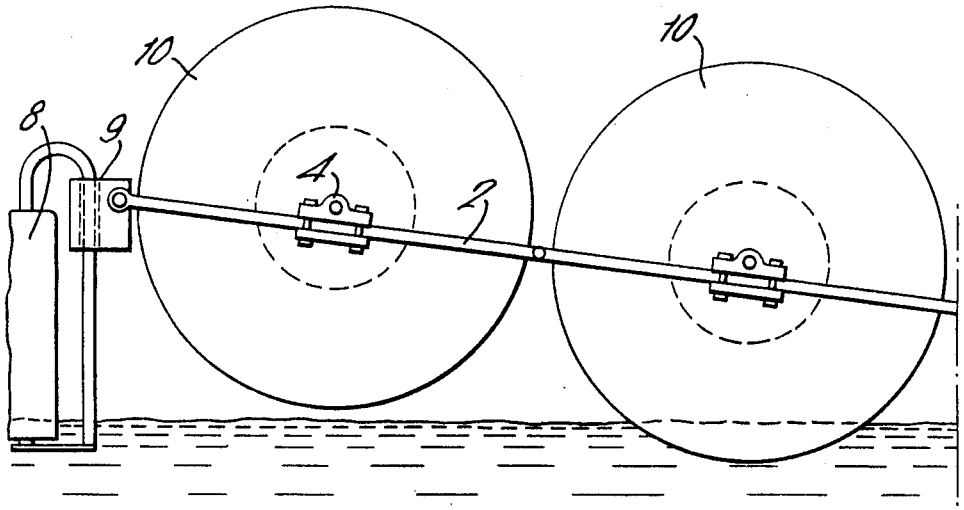
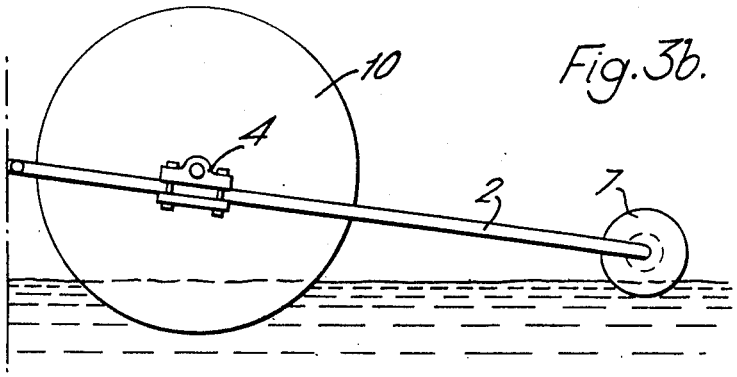
Fig. 3b.

ARRANGEMENT FOR HAULING UP, LAUNCHING AND STORING OF BOATS AND THE LIKE

The invention relates to an arrangement for hauling up, launching and storing of boats and the like, consisting of rollers mounted in sequence.

It has long been known to lay logs to facilitate the slip of boats on hauling. In recent times, mounted rollers have been used which cause even less friction and facilitate the hauling up of boats. All such arrangements were intended for hauling up of boats to their storing location on land.

This has meant that the use of such arrangements has not yet been developed to a great degree, inasmuch as there are only a few locations where such arrangements can be provided at a reasonable cost.

The object of the invention is to provide an arrangement which is preferably adapted to utilization in connection with floating stages and, in this manner, much landing stage place can be saved and a further advantage is that when a boat is hauled up, fouling is avoided.

This object is achieved by an arrangement which is characterized in the claims.

In the present invention, the traditional rollers are replaced by rollers consisting of buoyant elements, and, inasmuch as it is the said buoyant elements which support the weight of the boat, only a lightweight frame is necessary for mounting, in effect for control of the rollers. The said frame is secured in articulated and vertically slidable manner to the floating stage or other securing points. A second feature of the invention is that the said rollers can, to advantage, be formed such as to support the sides of the boat on either side of the keel, and thereby maintain the boat in correct position during storage.

The most practical utilization of the invention is to mount rollers of diminishing size on the frame from the vertical slide attachment, so that the opposing end of the frame is preferably in the surface of the water. The boat will then readily enter onto the first roller and press this down. If the boat is then drawn up further, it bears against the second rollers which are then pressed down into the water and begin to raise the boat. The boat is thus drawn up so that, preferably, its centre of gravity is in front of the last roller and it rests with its bow or stern on the stage. The rollers can be cylindrical rollers, elongate in transverse direction, with a construction or recess in the centre thereof for the keel of the boat.

With larger boats, it may of course be necessary to mount two or more uniform-sized elongate rollers adjacent the vertical slide securement, and rollers of diminishing size thereafter, however, arranged such that the centre of gravity of the frame is on the side where the small rollers are secured and maintains the said rollers down to the surface of the water. The rollers can preferably be effected as hollow bodies and filled with air, or preferably with plastic foam, consisting of closed cells. The rollers can be divided into two, with a through axis which connects the two parts together. It may also be expedient, particularly for heavier boats, to provide a reinforcement for the portion where the keel touches or bears against the rollers.

In place of divided rollers, it may also be expedient to use spherically shaped rollers mounted in pairs. The frame may then be a central rod with pivotable side arms arranged in pairs which form the rotational axes of the buoyancy elements.

By means of the invention, therefore, the boats remain hauled out of the water, while at the same time they are located against the stage. With the special shape of the buoyancy elements, they are also very well supported and can be stored in this manner for long periods of time.

The invention is also suitable in locations where, for example, small sailing dinghies are drawn up on land and it can also replace the slipway which is otherwise necessary.

The drawings illustrate in diagram examples of two possible embodiment examples of the invention.

Figure 4:
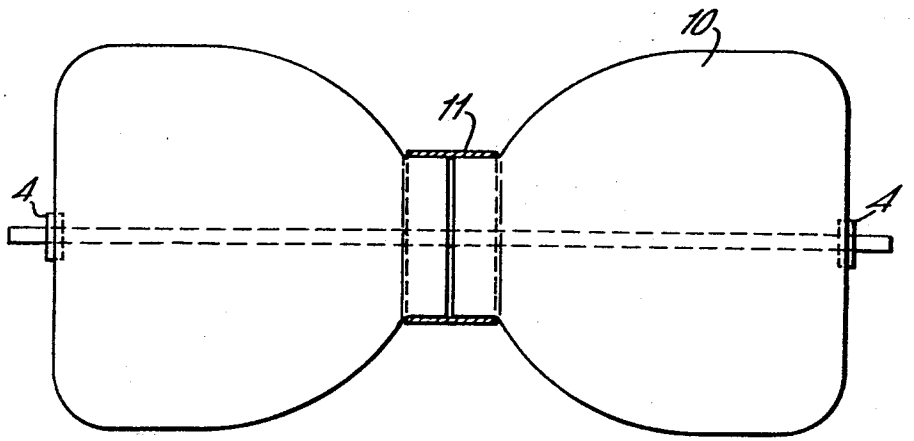
Figure 5:
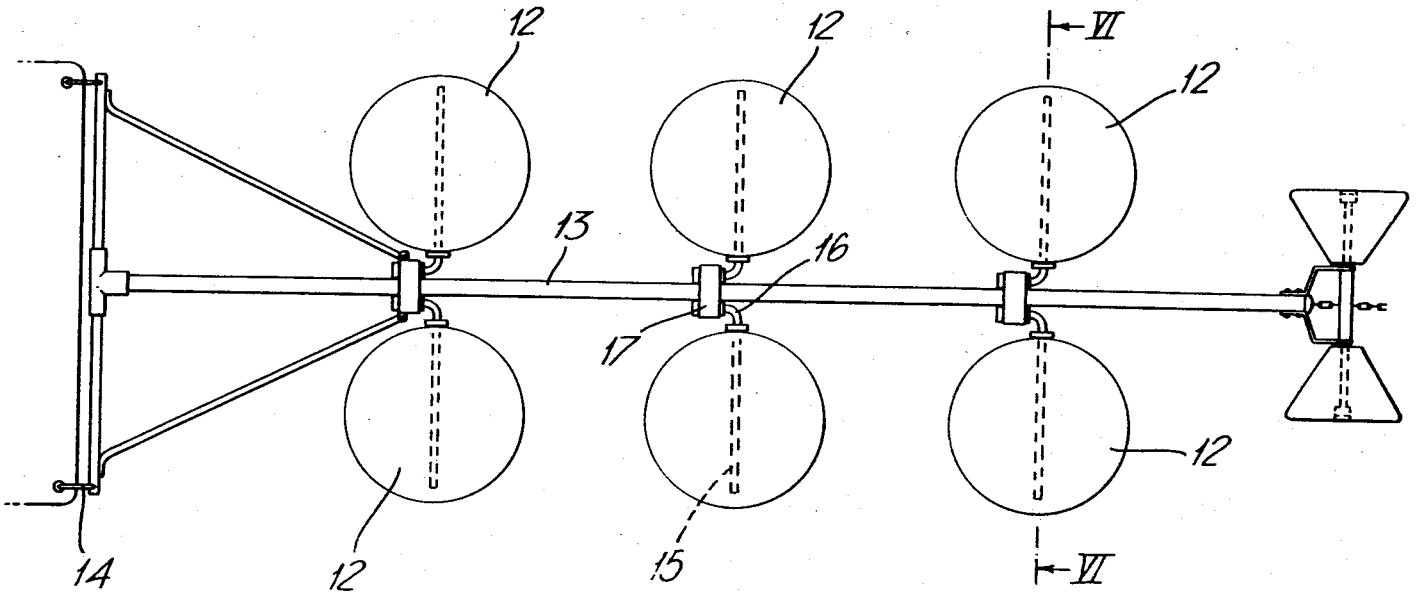
Figure 6:
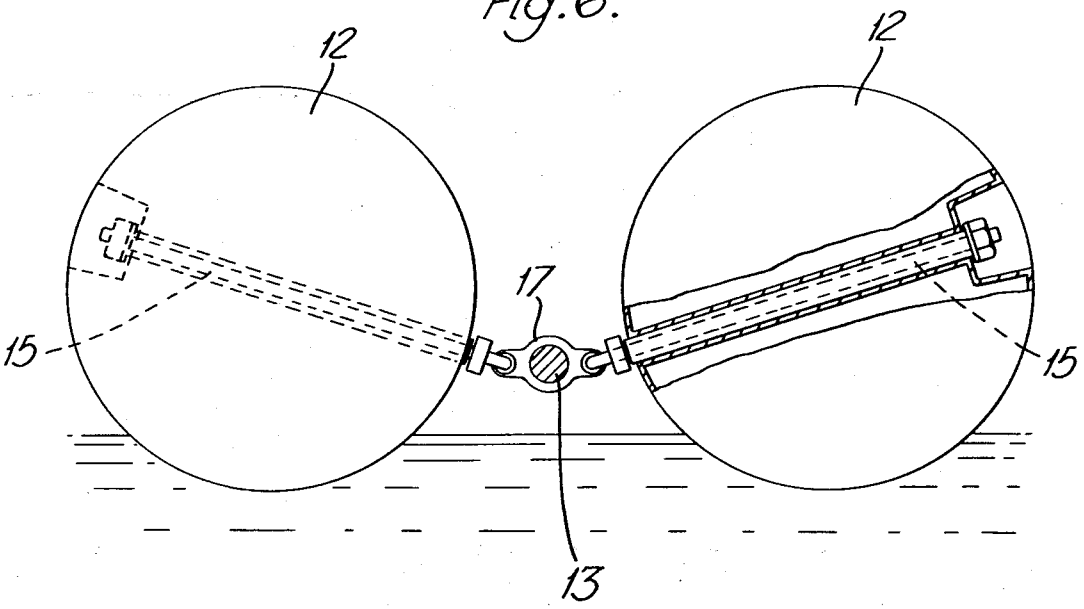

FIGS. 3(*a*) and 3(*b*) together comprise a side view of a modification of the first embodiment of the invention for use with larger boats (the left hand edge of FIG. 3(*b*) connects with the right hand edge of FIG. 3(*a*);

FIG. 4 shows a buoyancy element divided into two sections;

FIG. 5 shows a second embodiment of the invention in plan view and;

FIG. 6 is a sectional view taken along the line VI—VI of FIG. 5.

Figure 1:
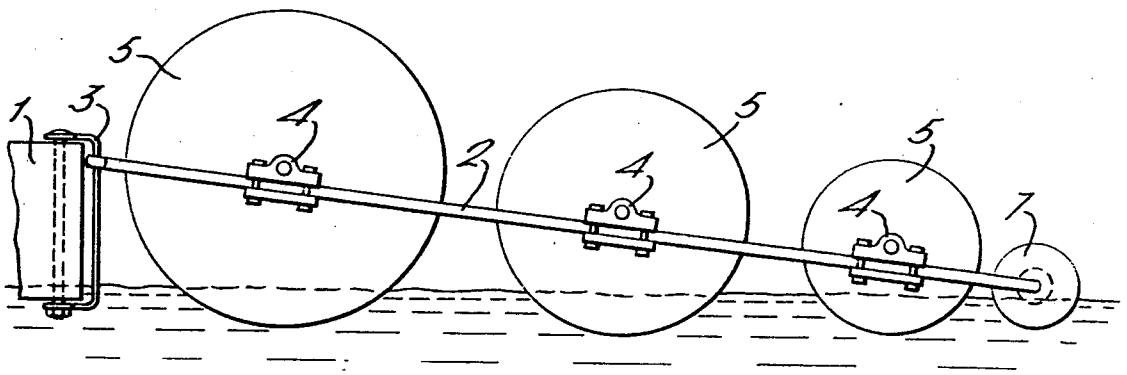
FIG. 1 illustrates a side view of a first embodiment of the invention.
Figure 2:
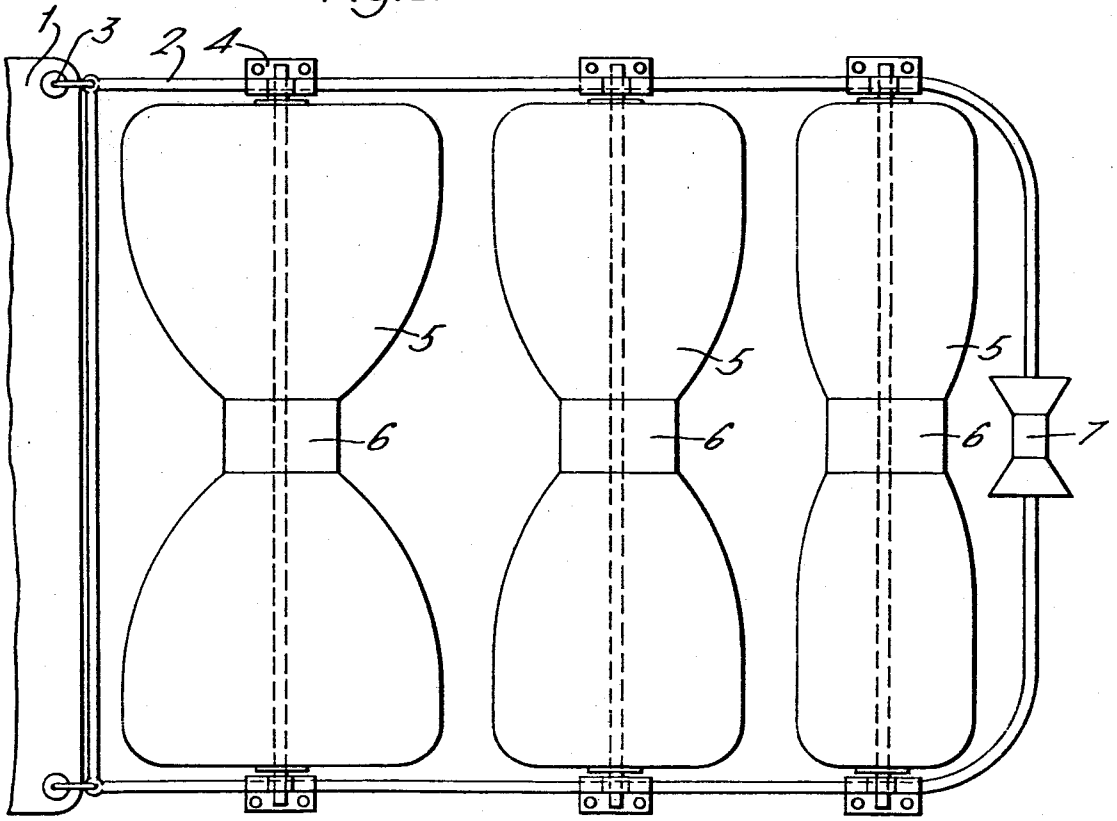
FIG. 2 illustrates a plan view of the embodiment of FIG. 1.

On FIGS. 1 and 2, a tubular frame 2 is secured to a floating stage 1, said frame being vertically displaceable on a rod 3. On the frame 2, roller bearings 4 are provided to which are mounted the buoyancy elements 5. The buoyancy element closely adjacent the stage 1 has the largest diameter. The diameter of the elements tapers towards the central portion 6 as illustrated on FIG. 2. Outermost on the frame 2 a smaller buoyancy element 7 is rotatably mounted direct.

FIGS. 3*a* and *b* illustrate a larger-sized corresponding unit secured to a larger-size stage 8 with a vertically displaceable guide 9 which corresponds to that on FIG. 1. The buoyancy elements 10 are here divided into two, as illustrated on FIG. 4, and have a reinforcement 11 at the central portion thereof. All the buoyancy elements have through rotational axles.

FIGS. 5 and 6 illustrate a second embodiment where spherical buoyancy elements 12 are utilized. All elements 12, in the example illustrated, are of equal size and are mounted in pairs on either side of a frame 13. The frame 13 is constituted by a rod which is rigidly connected to a guide 14 so that it can be moved vertically. The shaped buoyancy elements 12 are secured rotatably to through axles 15. The said axles have an angular extension 16 which is pivotally secured to a bearing housing 17 mounted on the frame 13. In order to limit the vertical movements of the buoyancy elements, stop means can be provided in the form of lugs or the like in manner known per se.

As will be appreciated, any of the above embodiments or modifications of the device may be secured for vertical movement with respect to any suitable base means. As used herein and in the claims "base means" refers to any suitable base to which the device may be secured for vertical movement and includes inter alia the floating stage 1, the larger size floating stage 8, a fixed quay secured or projecting from shore or supported from the bottom of the body of water, as well as any projection from land.

Having described my invention, I claim:

1. A device of the type disclosed for hauling up, storing, or launching boats or the like at a base means comprising a frame; means securing said frame to said base means; said securing means including means permitting relative vertical movement between said base means and said frame; buoyancy elements rotatably mounted on said frame; said frame extending outwardly from said base means over a body of water with at least one of said buoyancy elements floating in said body of water; said at least one buoyancy element partially supporting said frame from said body of water during haul up and launching of a boat while said frame is secured by said securing means to said base means; said at least one buoyancy element directly engaging, at least partially supporting from said body of water, and rollingly guiding a boat hull during haul up and launching of a boat while simultaneously at least partially supporting said frame as aforesaid; and movement of said boat on said buoyancy elements during haul up and launching causing rotation of said at least one element floating in water.

2. The device of claim 1 in which said base means is a floating stage.

3. The device of claim 1 in which said base means is a fixed quay.

4. Arrangement according to claim 1, characterized in that the buoyancy elements are formed externally such that they give support to the sides of the boat on either side of the keel.

5. Arrangement according to claim 1, characterized in that the buoyancy elements are effected as hollow bodies, filled with air.

6. Arrangement according to claim 1, characterized in that the buoyancy elements are spherically shaped members mounted in pairs.

7. Arrangement according to claim 6, characterized in that the frame is disposed between the spherical buoyancy elements.

8. Arrangement according to claim 7, characterized in that the rotational axes of the spherical buoyancy elements are secured vertically movable to the frame.

9. Arrangement according to claim 1, characterized in that two preferably equal-sized buoyancy elements are mounted on the frame in juxtaposed manner, and that at least one pair of smaller buoyancy elements are also mounted on the frame and that the centre of gravity of the frame is such that the smaller buoyancy elements are held down in the water surface.

10. Arrangement according to claim 1, characterized in that the buoyancy elements are cylindrical in shape with a recess in the centre thereof.

11. A device of the type disclosed for hauling up, storing, or launching boats or the like at a base means comprising a frame, said frame being secured to said base means for vertical movement relative thereto, buoyancy elements rotatably mounted on said frame, said frame extending outwardly from said base means over a body of water with at least one of said buoyancy elements floating in said body of water, said buoyancy elements being so arranged as to serve the dual purpose of at least partially supporting said frame and supporting and guiding a boat, and said buoyancy elements being arranged in diminishing size in the direction away from the base means.

12. A device of the type disclosed for hauling up, storing, or launching boats or the like at a base means comprising a frame, said frame being secured to said base means for vertical movement relative thereto, buoyancy elements rotatably mounted on said frame, said frame extending outwardly from said base means over a body of water with at least one of said buoyancy elements floating in said body of water, said buoyancy elements being so arranged as to serve the dual purpose of at least partially supporting said frame and supporting and guiding a boat, and said buoyancy elements being hollow bodies filled with a foam material with closed cells.

* * * * *